United States Patent [19]

Koeller

[11] Patent Number: 4,685,509

[45] Date of Patent: Aug. 11, 1987

[54] COOLING DEVICE FOR A MULTISTAGE COMPRESSOR

[75] Inventor: Walter Koeller, Duisburg, Fed. Rep. of Germany

[73] Assignee: Mannesmann Aktiengesellschaft, Duesseldorf, Fed. Rep. of Germany

[21] Appl. No.: 766,654

[22] Filed: Aug. 19, 1985

[30] Foreign Application Priority Data

Aug. 17, 1984 [DE] Fed. Rep. of Germany ..... 3430782
Aug. 15, 1985 [DE] Fed. Rep. of Germany ..... 3513936

[51] Int. Cl.[4] ..... F04D 29/58

[52] U.S. Cl. ..... 165/47; 165/111; 165/145; 165/140; 165/160; 415/179; 417/243

[58] Field of Search ..... 165/111, 114, 145, 47, 165/140, 160; 417/243; 62/93; 415/179

[56] References Cited

U.S. PATENT DOCUMENTS

| | | | |
|---|---|---|---|
| 2,312,335 | 3/1943 | Halleck | 417/243 |
| 2,832,131 | 4/1958 | Leitner et al. | 165/114 |
| 3,001,692 | 9/1961 | Schierl | 415/179 |
| 3,031,131 | 4/1962 | Hildebrandt | 417/243 |
| 3,271,934 | 9/1966 | Shields | 165/111 |
| 3,355,097 | 11/1967 | Hornschuch | 415/179 |
| 3,476,485 | 11/1969 | Kunderman | 415/179 |
| 3,658,442 | 4/1972 | Heitmann et al. | 415/179 |
| 4,288,204 | 9/1981 | Viertler | 417/243 |
| 4,415,024 | 11/1983 | Baker | 165/111 |
| 4,550,775 | 11/1985 | Edwards et al. | 165/111 |
| 4,561,498 | 12/1985 | Nowobilski et al. | 165/160 |

FOREIGN PATENT DOCUMENTS 355741 7/1922 Fed. Rep. of Germany ..... 165/111

OTHER PUBLICATIONS

Mannesmann Demag, Vierstufige Getriebe-Turboverdichter Typ VK Prospectus, published Oct. 1981.

*Primary Examiner*—William R. Cline
*Assistant Examiner*—John K. Ford
*Attorney, Agent, or Firm*—Oblon, Fisher, Spivak, McClelland & Maier

[57] ABSTRACT

The invention relates to a cooling device for a multi-stage compressor in which two coolers are placed in a common housing. The two coolers cool the medium of the preceiding stage of the multi-stage compressor heated by the input compressor work. The common housing has chambers that are divided into different pressure stages, are connected to the multi-stage compressor by inlet tubes and outlet tubes, and contain water separators with condensate removal pipes associates with them. To be able to conduct the medium to be cooled with a minimum of pressure drops, dividing walls (13, 23) are provided at a distance from the top and bottom end, respectively, of the cooling housing (50). Each dividing wall (13, 23) forms a cylindrical space (24, 14) with the housing wall (51) and the respective end walls (57, 56) of the cooling housing (50) for the installation of the water separators (15, 25).

8 Claims, 6 Drawing Figures

Fig. 6 (C-C)
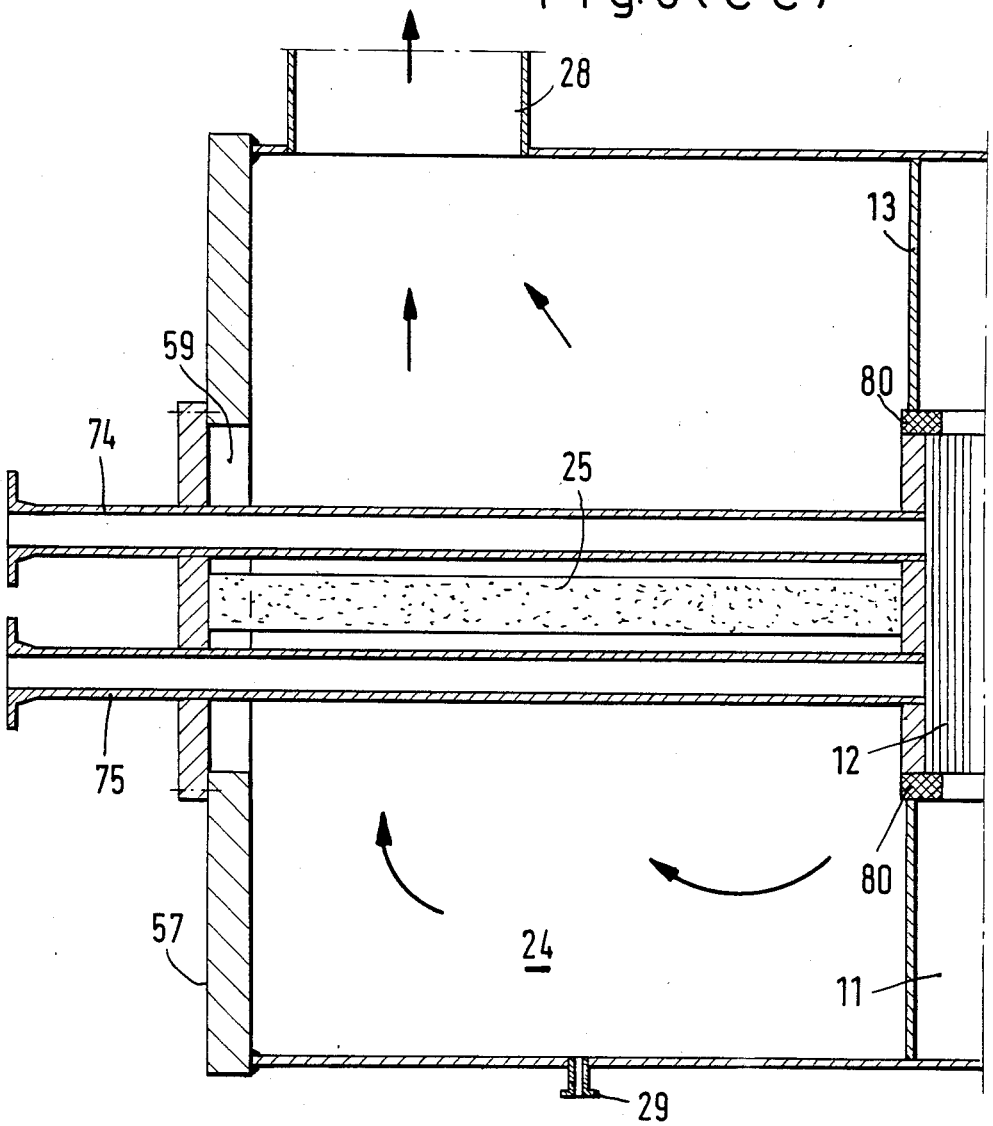

COOLING DEVICE FOR A MULTISTAGE COMPRESSOR

BACKGROUND OF THE INVENTION

Field of the Invention

The invention relates to a cooling device for a multistage compressor in which two coolers are placed in a common housing. The two coolers cool the medium of the preceding stage of the multistage compressor, the medium having been heated by the input compressor work. The common housing has chambers that are divided into different pressure stages, are connected to the multistage compressor by inlet tubes and outlet tubes, and contain water separators with condensate removal pipes associated with them.

Multistage compressor installations with a delivery capacity of between 20,000 and 200,000 $m^3/h$ at final pressures between 6 and 12 bar are used for compressing air or similar gases. Multistage compressor installations achieve final pressures of up to 40 bar with a suction pressure of 5 to 6 bar.

For some applications, a compact design (a so-called "package") is required. In the compact design of a compressor installation, the coolers occupy a relatively large volume of the total installation. In a four-stage compressor, a total of four coolers are required when an after cooler is employed.

Compressor installations of compact design are known from prospectus MA 23.42/10.81 of the Mannesmann Demag firm. Because of their size, the coolers largely determine the space requirements of the compressor installation (see the photographs on the lower part of page 6 of the prospectus).

In the case of water cooling, oblong containers with circular bases are usually used as coolers. Axially parallel cooling elements are installed in the oblong containers. Cooling water flows through the cooling elements. Water separators are placed parallel to the cooling elements. The medium to be cooled is conducted by baffles.

A significant disadvantage of the known coolers is that they deflect the medium up to six times in the cooler. This is particularly true if the water separator is placed parallel to the cooling elements. Each deflection, of course, causes a pressure drop.

OBJECT OF THE INVENTION

The object of the invention is to design a cooling device of the type initially mentioned in which the medium to be cooled can be conducted with a minimum of pressure drops.

SUMMARY OF THE INVENTION

Through the arrangement of the water separator in a chamber separated from the cooling element space, the medium can be conducted not only vertically through the water separator but can also be conducted vertically through the cooling elements without prior deflection. This, the medium to be cooled is deflected only twice.

The special chamber for the water separator makes possible utilization of the full diameter of the housing and thus permits adequate dimensioning of the water separators. In that way, the entire interior space of the cylindrical space can be used, and the water separators can be arranged in series or superposed in steps.

The cooling water pipes run through the space of the respective pressure stage, by-passing the water separators. The preferred type of construction is the arrangement of the entire cooling water feed on one side of the cooling device. For this purpose, the space of the one cooler is separated through pressure by seals from the chamber of the other cooler. In this type of construction, a simple replacement of cooling elements is possible, especially if they are installed drawerlike.

BRIEF DESCRIPTION OF THE DRAWINGS

Various other objects, features and attendant advantages of the present invention will be more fully appreciated as the same becomes better understood from the following detailed description when considered in connection with the accompanying drawings in which like reference characters designate like or corresponding parts throughout the several views and wherein:

FIG. 4 is a section on the plane A—A in FIG. 3.

FIG. 5 is a section on the plane B—B in FIG. 3.

FIG. 6 is a section on the plane C—C in FIG. 2.

DETAILED DESCRIPTION OF THE PRESENTLY PREFERRED EMBODIMENT

Figure 1:
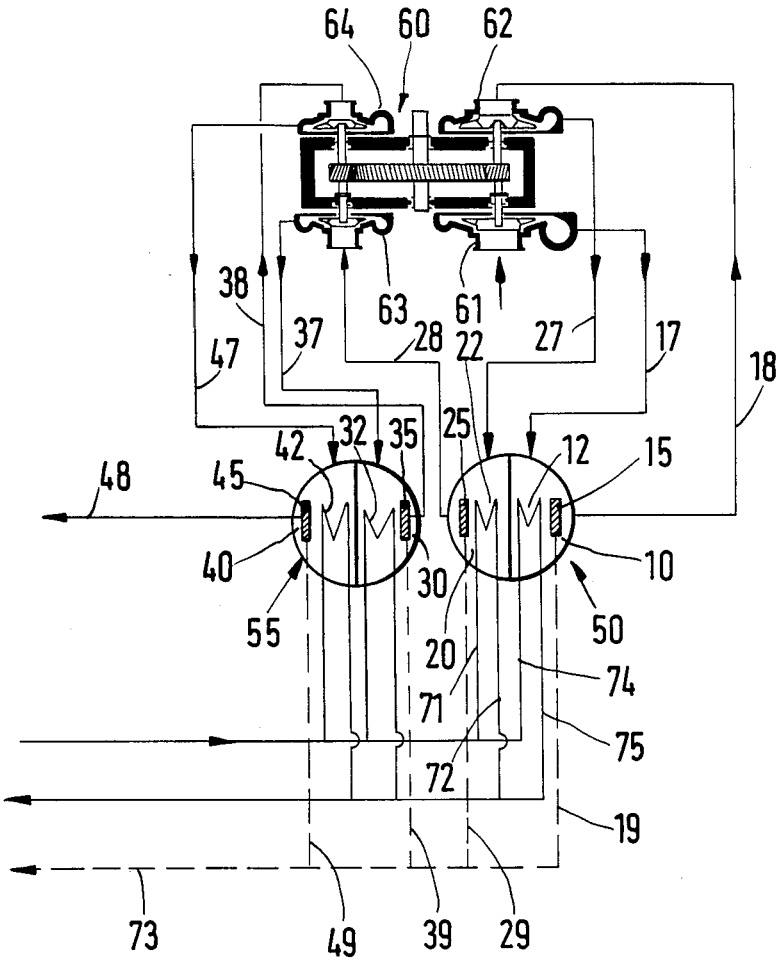
FIG. 1 is a diagram of a compressor installation.

FIG. 1 shows the flow and cooling-water diagram of a four-stage geared turbocompressor with aftercooling. A compressor 60 has four compressor stages, 61, 62, 63, and 64, placed on the two sides of its gear case as shown. The compressor stages 61 and 62 are connected to a cooler housing 50 by inlet tubes 17 and 27 and an outlet tube 18. The compressor stages 63 and 64 are connected to a cooler housing 55 by inlet tubes 37 and 47 and a outlet tube 38. An outlet tube 28 connects the cooler housing 50 to the compressor stage 63, and an outlet tube 48 leads from the cooler housing 55. Coolers 10 and 20 are placed in the cooler housing 50, and coolers 30 and 40 are placed in the cooler housing 55. The connecting conduits between the compressor stages and the cooler housing are divided into inlet tubes 17, 27, 37, and 47 and outlet tubes 18, 28, 38, and 48.

Cooling water feed pipes 71 and 74 run to cooling elements 22 and 12 contained in chambers 21 and 11, respectively, in the cooler housing 50. The cooling elements 22 and 12 in turn are connected to cooling water removal pipes 72 and 75, respectively. A corresponding cooling water feed and removal is provided for cooling elements 32 and 42 placed in the cooler housing 55. Each cooling element 12, 22, 32, and 42 is assigned a corresponding water separator 15, 25, 35, and 45. The condensate formed in the water separators 15, 25, 35, and 45 is removed by means of condensate conduits 19, 29, 39, and 49 leading to a condensate collection conduit 73.

Figure 2:
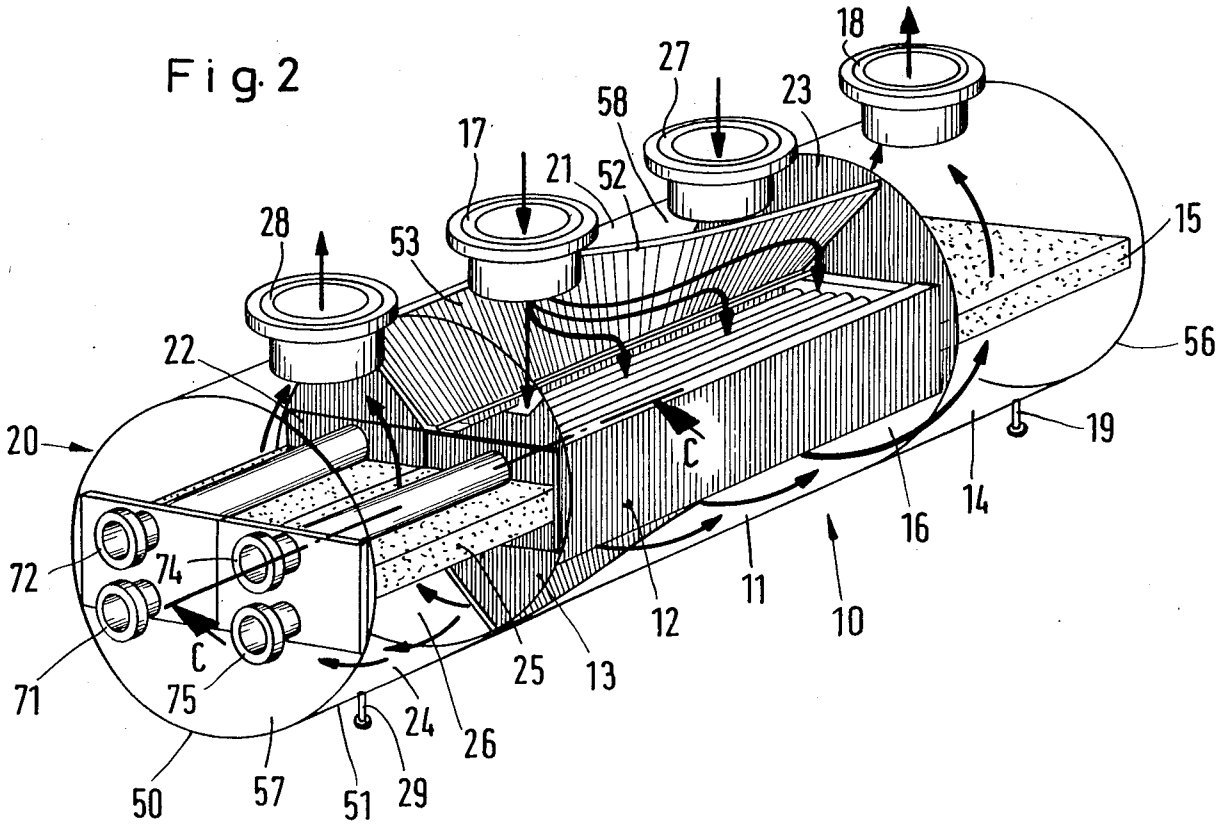
FIG. 2 is a perspective representation of a two-chamber cooler, which shows the interior design of the cooler.

FIG. 2 is a perspective representation of the cooler housing 50 containing the coolers 10 and 20. However, the cooler 20 is not visible because it is covered by other parts. In the cooler housing 50, (which is preferably cylindrical and has a cylindrical housing wall 51), the cooling elements 12 and 22 are placed axially parallel. There is a dividing wall 52 between the cooling elements 12 and 22. The dividing wall 52 has a helical shape in the area above the cooling elements 12 and 22 and forms free spaces 53 and 58 with the housing wall 51 above the cooling elements 12 and 22, respectively.

In the greater part of the free space 53, the inlet tube 17 is placed in the housing wall 51.

The arrows in FIG. 2 show the direction of flow of the medium to be cooled. The medium is conducted vertically through the cooling elements 12 and 22.

At a distance from the top and bottom ends, respectively, of the cooling housing 50 are provided dividing walls 13 and 23. The dividing walls 13 and 23 are placed at a right angle to the center axis of the cooler housing 50. The dividing walls 13 and 23 form cylindrical spaces 24 and 14, respectively with the housing wall 51 and end walls 57 and 56. The dividing wall 13 has an aperture 26 in the area below the cooling element 12. After leaving the cooling element 22, the medium flows through the aperture 26 into the cylindrical space 24.

The water separator 25 is placed horizontally in the cylindrical space 24. For reasons of assembly, the water separator 25 is divided vertically in the direction of the center axis. The cooling water feed pipes 71 and 74 and the cooling water removal pipe 72 and 75 are axially parallel to the center axis of the cylindrical space 24. The outlet tube 28 is placed in the upper part of the cylindrical space 24. In the greater part of the free space 58, the inlet tube 27 is placed in the housing wall 51, and the outlet tube 18 is placed in the upper part of the cylindrical space 14. The medium flows from the cooling element 12 through an aperture 16 in the dividing wall 23, through the water separator 15, and into the outlet tube 18. The water precipitated by the water separators is removed from the cylindrical spaces 14 and 24 by the condensate conduits 19 and 29, respectively.

Figure 3:
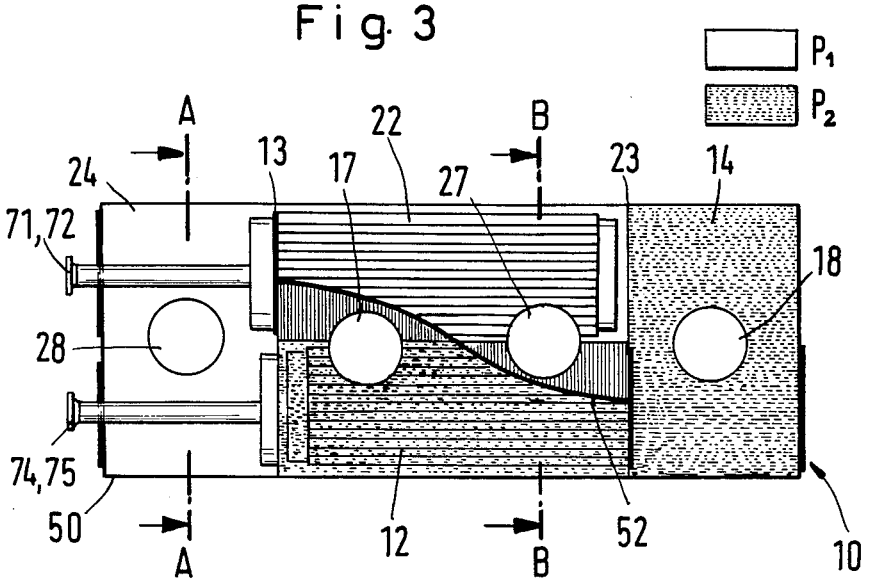
FIG. 3 is a diagrammatic representation of the cooler.
Figure 3:
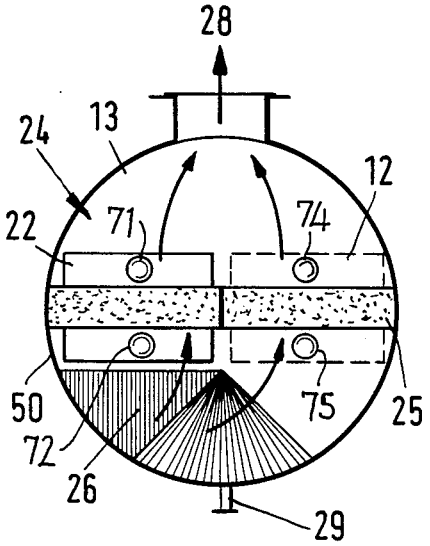
Figure 3:
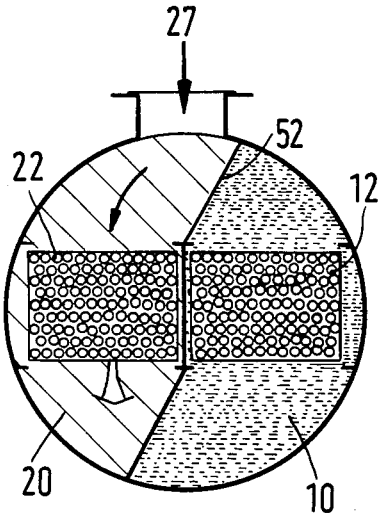

FIG. 3 diagrammatically shows the cooler housing 50 with pressure stages P1 and P2, which are separated from one another by dividing walls 13 and 23. The cooling elements 12 and 22 are placed parallel to one another. The upper part of the dividing wall 52 is helical. The inlet tubes 17 and 27 are placed in the vertex of the cooler housing 50.

Because of the strong spiral of the dividing wall 52, there is the possibility of varying the connecting point of the inlet tubes 17 and 27 over a relatively large range depending on operational needs. The outlet tubes 18 and 28 are also placed in the vertex of the cooler housing 50 and also can be adapted to the operational conditions by shifting the connecting points. The cooling water feed pipes 71 and 74 and the cooling water removal parts 72 and 75, respectively, are run through the cylindrical space 24.

FIG. 4 shows the section A—A of FIG. 3. The dividing wall 13 is closed to the cooling element 12 and has the aperture 26 leading to the cooling element 22. The water separator 25 is placed horizontally in the cylindrical space 24. The condensate is removed by the condensate conduit 29. The medium is conducted vertically through the water separator 25 and leaves the cooling housing 50 by the outlet tube 28.

FIG. 5 shows the section B—B of FIG. 3. The medium to be cooled reaches the cooler housing 50 by the inlet tube 27 and is conducted through the dividing wall 52 to the cooling element 22. Depending on the angle of the helical part of the dividing wall 52, the placement of the inlet tube 27 in the vertex of the cooler housing 50 can be varied over a relatively wide area.

FIG. 6 shows the section C—C of FIG. 2 in the area of the cylindrical space 24. The cooling water feed pipe 74 and the cooling water removal pipe 75 and in the front area of the chamber 11. Both pipes 74 and 75 penetrate the end wall 57 of the cylindrical space 24. An assembly opening 59 that can be locked is provided in the end wall 57. The cooling element 12 can be pulled through the assembly opening 59. Sealing elements 80 (preferably made of rubber and preferably up-shaped) are provided between the outer wall of the cooling element 12 and the dividing wall 13. The sealing elements 80 separate the chamber 11 from the cylindrical space 24. Gas coming from the chamber 21 (not visible in the drawings) flows through the cylindrical space 24 and leaves it by the outlet tube 28. The water separator 25 is placed cross-wise to the direction of flow of the gas. The precipitated condensate is removed by the condensate conduit 29.

Obviously, numerous modifications and variations of the present invention are possible in light of the above teachings. It is therefore to be understood that, within the scope of the appended claims, the invention may be practiced otherwise than as specifically described herein.

What is claimed as new and desired to be secured by Letters Patent of the United States is:

1. A cooling device for cooling the gas in a multistage compressor, said cooling device comprising:

(a) a cylindrical housing having a first end wall, a second end wall, a central axis, and a cylindrical housing wall;

(b) a first dividing wall perpendicular to the central axis of said cylindrical housing spaced from said first end wall of said cylindrical housing and a second dividing wall perpendicular to the central axis of said cylindrical housing spaced from said secodd end wall of said cylindrical housing, said first and second dividing walls dividing said cylindrical housing into a first cylindrical space, a central chamber, and a second cylindrical space;

(c) a first cooling element located in said central chamberand extending parallel to the central axis of said cylindrical housing;

(d) a second cooling element located in said central chamber and extending parallel to the central axis of said cylindrical housing and to said first cooling element;

(e) a first water separator located in said first cylindrical space, said first water separator extending between said first end wall and said first dividing wall and dividing said first cylindrical space into a top half and a bottom half;

(f) a second water separator located in said second cylindrical space, said second water separator extending between said second end wall and said second dividing wall and dividing said second cylindrical spaced into a top half and bottom half;

(g) a first inlet tube which, during use of the cooling device, leads from the multistage compressor and communicates with said central chamber adjacent said first cooling element;

(h) a second inlet tube which, during use of the cooling device, leads from the multistage compressor and communicates with said central chamber adjacent said second cooling element;

(i) a first outlet tube which, during use of the cooling device, leads from said first cylindrical space to the multistage compressor;

(j) a second outlet tube which, during use of the cooling device, leads from said second cylindrical space to the multistage compressor; and (k) a helical dividing wall which:

(i) is located in said central chamber;
(ii) is connected to said housing wall and to said first and second dividing walls;
(iii) runs axially parallel to the central axis of said cylindrical housing; and
(iv) and extends between sid first and second cooling elements;

wherein:

(l) there is first aperture in said first dividing wall through which the gas flows from said first cooling element to said first cylindrical space;
(m) there is a second aperture in said second dividing wall through which the gas flows from said second cooling element to said second cylindrical space;
(n) said helical dividing wall has a planar surface in the area between said first and second cooling elements and is helical in shape outside the ara between said first and second cooling elements;
(o) said helical dividing wall is composed of three straight-surface sections in cross-section perpendicular to the central axis of said cylindrical housing;
(p) a first helical part of said helical dividing wall, said first and second dividing walls, said cylindrical housing wall, and the inlet surface of said first cooling element define a first free space;
(q) a second helical part of said helical dividing wall, said first and second dividing walls, said cylindrical housing wall, and the inlet surface of said second cooling element define a second free space;
(r) said first free space tapers off in the direction of said first dividing wall; and
(s) said second free space tapers off in the direction of said second dividing wall.

2. A cooling device as recited in claim 1 wherein:
(a) said first outlet tube leads from said top half of said first cylindrical space and
(b) said second outlet tube leads from said top half of said second cylindrical space.

3. A cooling device as recited in claim 2 wherein:
(a) said first water separator is placed in a horizontal position and divides said first cylindrical space in a fluid-tight manner and
(b) said second water separator is placed in a horizontal postion and divides said second cylindrical space in a fluid-tight manner.

4. A cooling device as recited in claim 1 wherein:
(a) said first inlet tube connects with the broader part of said first free space through the upper surface of said cylindrical housing wall; and
(b) said second inlet tube communicates with the broader part of said second free space through the upper surface of said cylindrical housing wall.

5. A cooling device as recited in claim 4 and further comprising:
(a) a first cooling water feed pipe which is parallel to the central axis of said cylindrical housing, extends through said first end wall, said top half of said first cylindrical space, and said first dividing wall, and communicates with said first cooling element;
(b) a first cooling water removal pipe which is parallel to the central axis of said cylindrical housing, extends through said first end wall, said bottom half of said first cylindrical space, and said first dividing wall, and communicates with said first cooling element;
(c) a second cooling water feed pipe which is parallel to the central axis of said cylindrical housing, extends through said first end wall, said bottom half of said first cylindrical space, and said first dividing wall, and communicates with said second cooling element;
(d) a second cooling water removal pipe which is parallel to the central axis of said cylindrical housing, extends through said first end wall, said top half of said first cylindrical space, and said first dividing wall, and communicates with said second cooling element.

6. A cooling device as recited in claim 5 and further comprising a sealing element located between said first cooling element and said first dividing wall to seal said central chamber from said first cylindrical space.

7. A cooling device as recited in claim 6 wherein said sealing element is made of rubber.

8. A cooling device as recited in claim 7 wherein said sealing element is lip-shaped.

* * * * *